US008617317B1

(12) United States Patent
Levitt

(10) Patent No.: US 8,617,317 B1
(45) Date of Patent: Dec. 31, 2013

(54) ALL-PURPOSE CLEANERS WITH NATURAL, NON-VOLATILE SOLVENT

(75) Inventor: Mark Dennis Levitt, Lake Elmo, MN (US)

(73) Assignee: Ecolab USA Inc., Saint Paul, MN (US)

( * ) Notice: Subject to any disclaimer, the term of this patent is extended or adjusted under 35 U.S.C. 154(b) by 0 days.

(21) Appl. No.: 13/562,396

(22) Filed: Jul. 31, 2012

(51) Int. Cl.
*B08B 3/04* (2006.01)
*C11D 1/72* (2006.01)

(52) U.S. Cl.
USPC ..... 134/25.2; 134/25.3; 134/39; 134/42; 510/199; 510/238; 510/239; 510/240; 510/245; 510/421; 510/437; 510/474; 510/505; 424/488; 424/70.13; 424/70.31

(58) Field of Classification Search
USPC ..... 510/199, 238, 239, 240, 245, 421, 437, 510/474, 505; 424/488, 70.13, 70.31; 134/25.2, 25.3, 39, 42
See application file for complete search history.

(56) References Cited

U.S. PATENT DOCUMENTS

| | | | |
|---|---|---|---|
| 5,720,825 | A | 2/1998 | Kinnaird |
| 5,877,133 | A | 3/1999 | Good |
| 5,952,287 | A | 9/1999 | Gross et al. |
| 5,990,072 | A | 11/1999 | Gross et al. |
| 6,224,685 | B1 | 5/2001 | Gross et al. |
| 6,613,158 | B2 | 9/2003 | Gross et al. |
| 6,824,623 | B1 | 11/2004 | Gross et al. |
| 6,982,244 | B2 | 1/2006 | Gross et al. |
| 7,449,437 | B2 | 11/2008 | Gross et al. |
| 7,547,670 | B2 | 6/2009 | Gross et al. |
| 2006/0165739 | A1* | 7/2006 | Komesvarakul et al. ..... 424/401 |
| 2009/0093390 | A1 | 4/2009 | Gross et al. |
| 2009/0220437 | A1 | 9/2009 | Leber et al. |
| 2011/0190186 | A1 | 8/2011 | Collins |

FOREIGN PATENT DOCUMENTS

| | | | |
|---|---|---|---|
| DE | 10 2008 006 844 | A1 | 1/2009 |
| EP | 1 064 914 | A1 | 1/2001 |
| EP | 1 772 496 | A1 | 4/2007 |
| EP | 1 894 994 | A1 | 3/2008 |
| FR | 2 843 540 | A1 | 11/2002 |
| FR | 2 843 541 | A1 | 11/2002 |
| GB | 2 458 019 | A | 9/2009 |
| JP | 5-98480 | A | 4/1993 |
| JP | 11-246890 | A | 9/1999 |
| JP | 2000-87079 | A | 3/2000 |
| JP | 2000-229814 | A | 8/2000 |
| WO | WO 2006/004721 | A1 | 1/2006 |
| WO | WO 2006/074177 | A2 | 7/2006 |

(Continued)

OTHER PUBLICATIONS

English Abstract of Patent No. JP 2000-087079 A, Lion Corp, Mar. 28, 2000.

(Continued)

*Primary Examiner* — Brian P Mruk
(74) *Attorney, Agent, or Firm* — McKee, Voorhees & Sease, P.L.C.

(57) ABSTRACT

Renewable, non-volatile cleaning compositions incorporating ethyl ester solvents are disclosed. Preferred compositions employ non-volatile $C_{8-16}$ ethyl ester solvents. All-purpose cleaning compositions incorporating the non-volatile $C_{8-16}$ ethyl ester solvents, further include an alkyl polyglycoside surfactant, an alcohol ethoxylate surfactant, and water. Preferably the compositions are free of anionic, cationic and amphoteric surfactants and/or co-solvents. The invention also discloses methods employing the non-volatile solvent all-purpose cleaning compositions.

18 Claims, 3 Drawing Sheets

(56) References Cited

FOREIGN PATENT DOCUMENTS

| | | | | | |
|---|---|---|---|---|---|
| WO | WO 2010/057007 | A1 | | 5/2010 | |
| WO | WO 2011/075642 | A1 | | 6/2011 | |
| WO | WO 2011/089238 | A1 | | 7/2011 | |
| WO | WO 2012/057610 | | * | 3/2012 | ..... A01N 25/04 |

OTHER PUBLICATIONS

JP 5-98480, Nippon Petrochemicals, English translation, Apr. 20, 1993.
JP 2000-87079, Lion Corp., English translation, Mar. 28, 2000.
JP 11-246890, Lion Corp., English translation, Sep. 14, 1999.
JP 2000-229814, L'Oreal, English translation, Aug. 22, 2000.
EP 1 064 914, L'Oreal, English translation, Jan. 3, 2001.
FR 2 843 540, L'Oreal, English translation, Nov. 6, 2002.
FR 2 843 541, L'Oreal, English translation, Nov. 6, 2002.
WO 2006/004721, Cognis IP Management GmbH, English translation, Jan. 12, 2006.
WO 2006/074177, Mary Kay Inc., English translation, Jul. 13, 2006.
EP 1 894 994, Henkel KGaA, English translation, Mar. 5, 2008.
DE10 2008 006 844, Lin, Kuan-Jiuh, English translation, Jan. 8, 2009.
GB 2 458 019, Swales, Allen, English translation, Sep. 9, 2009.
WO 2010/057007, Archer Daniels Midland Company, English translation, May 20, 2010.
WO 2011/075642, Stepan Company, English translation, Jun. 23, 2011.
WO 2011/089238, Sun Chemical Corporation, English translation, Jul. 28, 2011.

* cited by examiner

ALL-PURPOSE CLEANERS WITH NATURAL, NON-VOLATILE SOLVENT

FIELD OF THE INVENTION

The invention relates to novel, renewable cleaning compositions incorporating non-volatile solvents. In particular, compositions with a $C_{8-16}$ ethyl ester non-volatile solvent, an alkyl polyglycoside surfactant, an alcohol ethoxylate surfactant, and water are disclosed, wherein the $C_{8-16}$ ethyl ester non-volatile solvent replaces at least about 40% of conventional solvents in an all-purpose cleaning composition. In certain embodiments, the compositions are free of anionic, cationic and amphoteric surfactants and/or co-solvents. The invention further relates to methods employing the non-volatile solvent all-purpose cleaning compositions.

BACKGROUND OF THE INVENTION

Federal regulations imposing restrictions on the amounts and classes of materials that can be used in solvent-systems (due to emissions into the atmosphere) have resulted in the need for cleaning compositions having low volatile organic compounds (VOCs). VOCs are well-known to contribute to overall air quality and therefore may be regulated by states and/or the federal government. Solvents employed in commercial cleaning compositions and having excellent cleaning properties are often high VOC content materials. These include, for example, glycol ethers, ether acetates, ketones, lower alkyl aromatic hydrocarbons and others.

Cleaning compositions employing solvents having lower VOCs have been a focus in commercial markets. For example, fatty acid methyl esters have been used as renewable, low VOC solvents. Exemplary esters include soy methyl esters and lauryl methyl esters. However, many low VOC solvent systems provide insufficient or inferior cleaning performance, such as the poor degreasing performance provided by soy methyl esters. Additional disadvantages to fatty acid methyl esters include unpleasant and potent odors, such as those exhibited by lauryl methyl esters, as well as the risk of hydrolyzation of the esters to form methanol, having known toxicity concerns.

Accordingly, it is an objective of the claimed invention to develop safe, renewable, low VOC cleaning compositions incorporating non-volatile solvents.

A further objective of the claimed invention to develop stable, low-odor and high performance solvents that are non-volatile for incorporation into cleaning compositions.

A further object of the invention is a safe, sustainable cleaning composition wherein at least a portion of conventional solvents, such as glycol ethers, methyl esters, hydrocarbon solvents and d-Limonene are replaced with non-volatile solvents.

BRIEF SUMMARY OF THE INVENTION

In an embodiment, the present invention all-purpose cleaning composition employing non-volatile solvents are disclosed. The composition may comprise, consist of and/or consist essentially of a non-volatile solvent replacing at least about 40% of conventional solvents; an alkyl polyglycoside surfactant and an alcohol ethoxylate surfactant; and water, wherein the composition is free of anionic, cationic and/or amphoteric surfactants.

In further embodiments of the invention all-purpose cleaning compositions employing non-volatile solvents are disclosed as comprising, consisting of and/or consisting essentially of: from about 0.1-25 wt-% of a $C_{8-16}$ ethyl ester non-volatile solvent replacing at least about 50% of conventional solvents; from about 1-20 wt-% of an alkyl polyglycoside surfactant and from about 1-20 wt-% of an alcohol ethoxylate surfactant; and water, wherein the composition is free of anionic, cationic and/or amphoteric surfactants, and wherein the composition is free of chlorinated solvents, benzene and aromatic hydrocarbons.

Further embodiments of the invention disclose methods of removing soils from a surface using a natural, non-volatile all-purpose cleaning composition, comprising: diluting a cleaner with water of dilution to form a use solution, wherein the cleaner comprises a $C_{8-16}$ ethyl ester non-volatile solvent replacing at least about 40% of conventional solvents, an alkyl polyglycoside surfactant, an alcohol ethoxylate surfactant, and water, wherein the composition is free of anionic, cationic and amphoteric surfactants and/or co-solvents; and contacting the surface with the use solution.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

Figure 1:
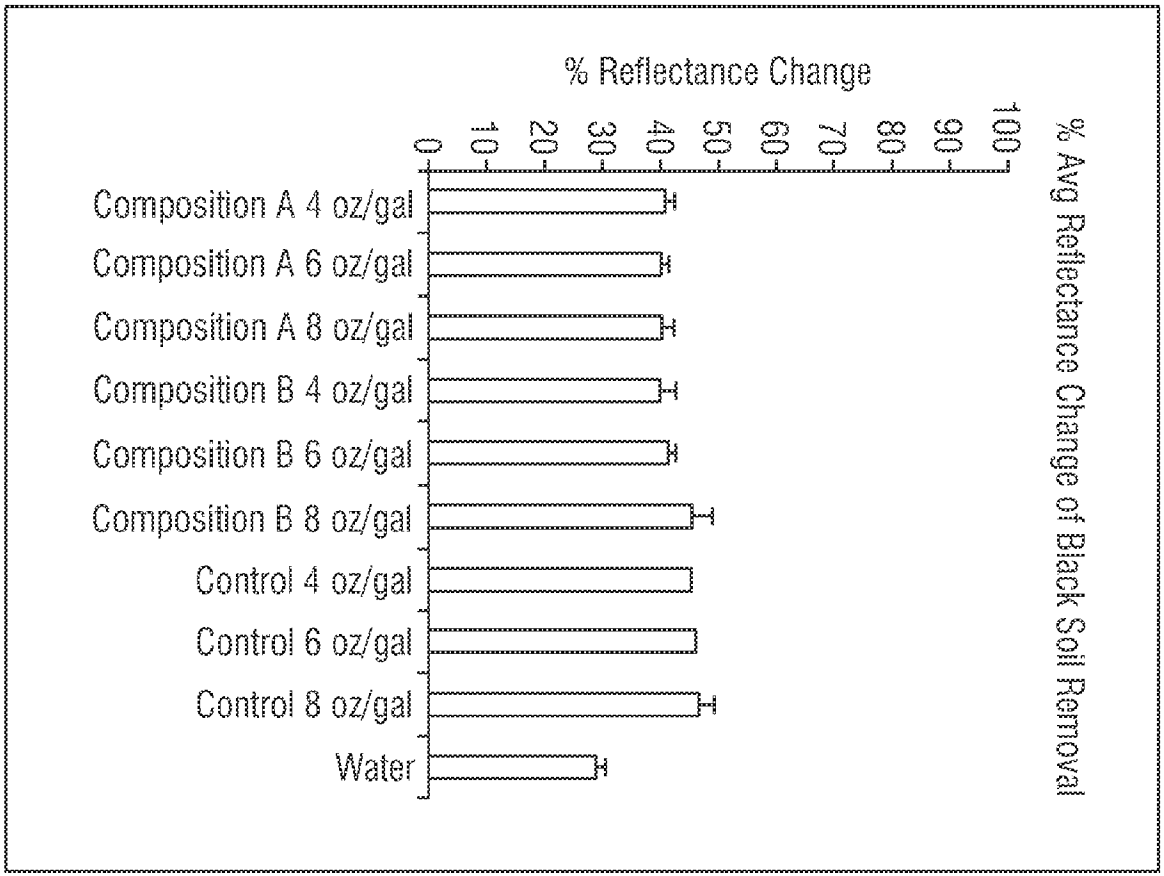
FIG. 1 shows efficacy of soil removal according to an embodiment of the invention described in Example 1. The percentage average reflectance change of black soil removal is shown using formulations according to the invention in comparison to a strong all-purpose cleaner (containing volatile solvents, representing a non-green cleaning product).

Various embodiments of the present invention will be described in detail with reference to the drawings, wherein like reference numerals represent like parts throughout the several views. Reference to various embodiments does not limit the scope of the invention. Figures represented herein are not limitations to the various embodiments according to the invention and are presented for exemplary illustration of the invention.

DETAILED DESCRIPTION OF THE PREFERRED EMBODIMENT

An advantage of the invention is the replacement of at least a portion of glycol ethers, methyl esters, hydrocarbon solvents, d-Limonene and/or other solvents with non-volatile solvents. In particular, ethyl laurate is identified as a suitable replacement for conventional, non-renewable product solvents. It is an advantage of the present invention that renewable cleaning compositions having low-VOC are provided without compromising on the efficacy of the cleaning compositions. The compositions of the present invention have many advantages over conventional cleaning compositions, including for example: providing safe, renewable, low VOC cleaning compositions; compositions lacking odor and/or having a low-odor profile due to the fatty acid chains of sufficient length (e.g. C8-C16); and providing high performance solvents that when incorporated into cleaning compositions provide at least substantially similar cleaning efficacy or superior efficacy to other compositions that do not employ the ethyl esters of the present invention.

The embodiments of this invention are not limited to particular compositions and methods of employing the same, which can vary and are understood by skilled artisans. It is further to be understood that all terminology used herein is for the purpose of describing particular embodiments only, and is not intended to be limiting in any manner or scope. For example, as used in this specification and the appended claims, the singular forms "a," "an" and "the" can include plural referents unless the content clearly indicates otherwise. Further, all units, prefixes, and symbols may be denoted in its SI accepted form. Numeric ranges recited within the specification are inclusive of the numbers defining the range and include each integer within the defined range.

So that the present invention may be more readily understood, certain terms are first defined. Unless defined otherwise, all technical and scientific terms used herein have the same meaning as commonly understood by one of ordinary skill in the art to which embodiments of the invention pertain. Many methods and materials similar, modified, or equivalent to those described herein can be used in the practice of the embodiments of the present invention without undue experimentation, the preferred materials and methods are described herein. In describing and claiming the embodiments of the present invention, the following terminology will be used in accordance with the definitions set out below.

The term "about," as used herein, refers to variation in the numerical quantity that can occur, for example, through typical measuring and liquid handling procedures used for making concentrates or use solutions in the real world; through inadvertent error in these procedures; through differences in the manufacture, source, or purity of the ingredients used to make the compositions or carry out the methods; and the like. The term "about" also encompasses amounts that differ due to different equilibrium conditions for a composition resulting from a particular initial mixture. Whether or not modified by the term "about", the claims include equivalents to the quantities.

The term "actives" or "percent actives" or "percent by weight actives" or "actives concentration" are used interchangeably herein and refers to the concentration of those ingredients involved in cleaning expressed as a percentage minus inert ingredients such as water or salts.

The term "alkyl" refers to a straight or branched chain monovalent hydrocarbon radical having a specified number of carbon atoms. Alkyl groups may be unsubstituted or substituted with substituents that do not interfere with the specified function of the composition and may be substituted once or twice with the same or different group. Substituents may include alkoxy, hydroxy, mercapto, amino, alkyl substituted amino, nitro, carboxy, carbonyl, carbonyloxy, cyano, methylsulfonylamino, or halogen, for example. Examples of "alkyl" include, but are not limited to, methyl, ethyl, n-propyl, isopropyl, n-butyl, s-butyl, t-butyl, n-pentyl, n-hexyl, 3-methylpentyl, and the like.

As used herein, the terms "alkyl phenol ethoxylate-free" or "NPE-free" refers to a composition, mixture, or ingredients that do not contain alkyl phenol ethoxylates or phenol-containing compounds or to which the same has not been added. Should alkyl phenol ethoxylates or -alkyl phenol ethoxylate containing compound be present through contamination of a composition, mixture, or ingredients, the amount of the same shall be less than 0.5 wt-%. In another embodiment, the amount of is less than 0.1 wt-% and in yet another embodiment, the amount is less than 0.01 wt-%. In certain embodiments of the invention, the all-purpose cleaning compositions are NPE-free. The term "cleaning" means to perform or aid in soil removal, bleaching, microbial population reduction, rinsing, or combination thereof.

As used herein, the term "hard surface" includes showers, sinks, toilets, bathtubs, countertops, windows, mirrors, transportation vehicles, floors, and the like. These surfaces can be those typified as "hard surfaces" (such as walls, floors, bedpans).

As used herein, the term "substantially free" refers to compositions completely lacking the component or having such a small amount of the component that the component does not affect the effectiveness of the composition. The component may be present as an impurity or as a contaminant and shall be less than 0.5 wt-%. In another embodiment, the amount of the component is less than 0.1 wt-% and in yet another embodiment, the amount of component is less than 0.01 wt-%.

The term "substantially similar cleaning performance" refers generally to achievement by a substitute cleaning product or substitute cleaning system of generally the same degree (or at least not a significantly lesser degree) of cleanliness or with generally the same expenditure (or at least not a significantly lesser expenditure) of effort, or both, when using the substitute cleaning product or substitute cleaning system rather than a conventional, non-'green' or renewable solvent cleaning compositions to address a typical soiling condition on a typical substrate. This degree of cleanliness may, depending on the particular cleaning product and particular substrate, correspond to a general absence of visible soils, or to some lesser degree of cleanliness.

The term "surfactant" or "surface active agent" refers to an organic chemical that when added to a liquid changes the properties of that liquid at a surface.

The term "VOC" and variations thereof, as used herein, refer to volatile organic compounds. VOCs have been found to be a major contributing factor to ozone, a common air pollutant. Ozone is not emitted into the air, but actually formed in the atmosphere through a photochemical process. VOCs in the air react with oxides of nitrogen and sunlight to form ozone. For this reason, the Environmental Protection Agency and other state regulatory agencies have determined that controlling VOCs is an effective method for minimizing ozone levels. Certain agencies may regulate the VOC levels of many consumer products with the goal of improving air quality. Consumer products are defined very broadly in these regulations and include many commercial and institutional products, including household products.

As used herein, the term "ware" includes items such as eating and cooking utensils. As used herein, the term "warewashing" refers to washing, cleaning, or rinsing ware.

The term "weight percent," "wt-%," "percent by weight," "% by weight," and variations thereof, as used herein, refer to the concentration of a substance as the weight of that substance divided by the total weight of the composition and multiplied by 100. It is understood that, as used here, "percent," "%," and the like are intended to be synonymous with "weight percent," "wt-%," etc.

The compositions and methods of the present invention may comprise, consist essentially of, or consist of the component and ingredients of the present invention as well as other ingredients described herein. As used herein, "consisting essentially of" means that the compositions and methods may include additional steps, components or ingredients, but only if the additional steps, components or ingredients do not materially alter the basic and novel characteristics of the claimed methods, systems, apparatuses, and compositions.

Compositions

According to an embodiment of the invention renewable, low VOC cleaning compositions are provided. The renewable cleaning compositions may comprise, consist of and/or consist essentially of a non-volatile solvent, an alkyl polyglycoside surfactant, an alcohol ethoxylate surfactant, water and optional functional ingredients.

Further description of the compositions, including preferred ranges of the components and percentage of actives in a liquid formulation are shown in Table 1.

TABLE 1

| | Wt-% | Wt-% | Wt-% | Preferred % Active |
|---|---|---|---|---|
| APG Surfactant | 0.1-50 | 1-50 | 5-20 | 0.1-20 |
| Alcohol Ethoxylate Surfactant | 0.1-50 | 1-50 | 5-20 | 0.1-20 |
| Ethyl Ester Solvent | 0.1-50 | 1-20 | 1-10 | 0.1-20 |
| Co-Solvent(s) | 0-50 | 0-15 | 0-10 | 0-20 |
| Additional Functional Ingredients (e.g. chelating agents, acidulants, stabilizing agents, etc.) | 0-25 | 0.1-25 | 1-25 | 0-10 |
| Water | 10-99 | 40-90 | 50-80 | — |
| Total | 100 | 100 | 100 | 1-50 |

The pH of the cleaning composition is preferably between about 4 and about 10. In particular, the pH of the of the cleaning composition is between about 5 and about 9, and more preferably between about 6 and about 8. As one skilled in the art appreciates, both high and low pH formulas are generally harsher to use, and in some cases require the use of personal protective equipment. In certain embodiments, low pH formulas include those having a pH below about 4 and high pH formulas include those having a pH above about 10. In aspects of the invention, the cleaning compositions are solutions or stable emulsions and/or suspensions. As used herein a stable emulsion is characterized by a lack of phase separation when the emulsion is allowed to stand at room temperature for at least seven days. Emulsions with a better performance will not phase separate when allowed to stand at room temperature for at least fourteen days and preferably at least 30 days.

In an aspect, the cleaning compositions are substantially free of chlorinated solvents, methyl esters (e.g. benzene) and/or aromatic hydrocarbons (e.g. aryl hydrocarbons such as xylene). Preferably, the cleaning compositions are free of chlorinated solvents, benzene and aromatic hydrocarbons. Preferably, the cleaning compositions are free of alkyl phenol ethoxylates, and are NPE-free.

In an aspect of the invention the renewable cleaning compositions have VOC less than about 1%. As used herein, VOC is defined as an organic compound with a vapor pressure greater than 0.1 mmHg at 20° C.

Non-Volatile Solvent

In an aspect of the invention, the renewable cleaning compositions replace at least a part of a conventional solvent. As used herein, conventional solvents refer to components contributing to the toxicity, odor and/or VOC of a use solution of a cleaning composition. Conventional solvents may also refer to petroleum-based solvents as opposed to the renewable, green, bio-preferred ethyl ester solvents of the present invention. Examples of such conventional solvents include, for example, glycol ethers, methyl esters, hydrocarbon solvents, ketones, methyl pyrrolidone and/or d-Limonene.

In an aspect of the invention, the renewable cleaning compositions replace at least about 40% of conventional solvents in a cleaning composition. In a further aspect, the renewable cleaning compositions replace at least about 50% of conventional solvents in a cleaning composition, preferably at least about 60%, more preferably at least about 70%. In most preferred aspects, at least about 80% to about 100% of conventional solvents are replaced with the renewable, non-VOC, safe solvent according to the invention.

In an aspect of the invention, the renewable cleaning compositions replace at least a part of the conventional solvent(s) with a renewable, non-VOC, safe solvent. Preferably the solvent has a low toxicity profile.

In an aspect of the invention, the non-volatile solvent is a short chain alcohol ester of a fatty acid, preferably a C1-C4 alcohol ester of a fatty acid. In preferred embodiments the alcohol ester is an ethyl ester of a fatty acid. In further embodiments, the solvent is an ethyl ester of a short to medium chain fatty acid. In preferred aspects, the solvent is an ethyl ester of a C8-C16 fatty acid, preferably an ethyl ester of a C10-C14 fatty acid, more preferably an ethyl ester of a C10-C12 fatty acid, and still more preferably an ethyl ester of a predominantly C12 fatty acid.

In additional embodiments, the solvent is a soluble ethyl ester. In certain embodiments, the solvent is a soluble ethyl ester of a predominantly C12 fatty acid, wherein at least 50% C12 fatty acid is present, at least 80% C12 fatty acid is present, at least 85% C12 fatty acid is present, or at least 90% C12 fatty acid is present.

In a preferred aspect of the invention the renewable, non-VOC, safe solvent is ethyl laurate (i.e. ethyl dodecanoate).

Beneficially, the ethyl ester of a C8-C16 fatty acid solvent overcomes the limitations of fatty acid methyl esters having unpleasant and potent odors. The malodors are a result of the use of shorter chain alcohol esters, such as lauryl methyl esters. The non-volatile solvents of the present invention have carbon chains that are short enough (preferably C10-C12) to provide good solvency, without having pronounced odors associated with short chain fatty acids, such as C6-C8 alcohol esters.

An additional benefit of the ethyl ester of a C8-C16 fatty acid solvents according to the invention is the readily available precursors for the solvents. In particular, ethanol is readily available, along with the fatty acid sources employed. C8-C16, preferably C10-C12 fatty acids are readily available from coconut and palm kernel oils. This is distinct from the shorter chain fatty acids (e.g. C6-C8 which are not as readily available and therefore increase the expense for compositions employing the same).

A further benefit of the ethyl ester of a C8-C16 fatty acid solvent is the elimination of hydrolyzation of the esters into methanol. In aspects of the invention the non-volatile solvent is not a methyl ester, such as those disclosed in U.S. Pat. No. 5,877,133, which is herein incorporated by reference. The use of methyl esters results in potential methanol toxicity, which is not present with ethanol resulting from hydrolyzation of ethyl esters. As a result, the non-volatile solvents do not present toxicity concerns. In addition, the ethyl ester of a C8-C16 fatty acid solvent provides a renewable, low VOC solvent for cleaning compositions while maintaining at least substantially similar cleaning efficacy. In various embodiments of the invention, the ethyl ester of a C8-C16 fatty acid solvent are incorporated into cleaning compositions demonstrated superior efficacy in comparison to compositions employing more volatile solvents.

In certain embodiments, compositions according to the invention employ between about 1 wt-% to about 20 wt-% ethyl ester solvent (such as ethyl laurate), preferably between about 3 wt-% to about 15 wt-% ethyl ester solvent, and more preferably between about 3 wt-% to about 10 wt-% ethyl ester solvent.

Co-Solvents

In an aspect of the invention, the renewable cleaning compositions replaces a portion of conventional solvents from a composition. In some aspects, the compositions are free of or substantially free of co-solvents. In embodiments where the renewable, non-VOC, safe solvent replaces less than 100% of conventional solvents, the compositions may employ a co-solvent.

Preferably, the co-solvents that are at least partially replaced include and/or are selected from the group consisting of glycol ethers, methyl esters, hydrocarbon solvents, d-Limonene and combinations of the same.

A co-solvents may be useful to provide enhanced cleaning performance (e.g. provide soil removal properties). A co-solvent may also be included to aid in emulsification of the composition due to the lack of water solubility of certain preferred solvent (e.g. ethyl laurate). In addition, a co-solvent may also be included to adjust the viscosity of the final composition. The intended final use of the composition may determine whether or not a co-solvent is included in the cleaning composition.

Suitable co-solvents may include, but are not limited to, ethanol and/or p-series glycol ethers. In some embodiments, amounts of glycol ethers are retained for formulating cold temperature stable cleaning compositions.

Additional suitable co-solvents may include, for example, oxygenated solvents such as lower alkanols, lower alkyl ethers, glycols, aryl glycol ethers and lower alkyl glycol ethers. Examples of other solvents include, but are not limited to, glycerol, ethanol, propanol, isopropanol and butanol, isobutanol, ethylene glycol, diethylene glycol, triethylene glycol, propylene glycol, dipropylene glycol, mixed ethylene-propylene glycol ethers, ethylene glycol phenyl ether, and propylene glycol phenyl ether. Substantially water soluble glycol ether solvents include, not are not limited to, propylene glycol methyl ether, propylene glycol propyl ether, dipropylene glycol methyl ether, tripropylene glycol methyl ether, ethylene glycol butyl ether, diethylene glycol methyl ether, diethylene glycol butyl ether, ethylene glycol dimethyl ether, ethylene glycol propyl ether, diethylene glycol ethyl ether, triethylene glycol methyl ether, triethylene glycol ethyl ether, triethylene glycol butyl ether and the like.

In certain embodiments, compositions according to the invention employ between about 0 wt-% to about 50 wt-% co-solvent(s), preferably between about 0 wt-% to about 25 wt-% co-solvent(s), and more preferably between about 0 wt-% to about 10 wt-% co-solvent(s).

Surfactants

The cleaning compositions according to the invention can contain a combination of surfactants that includes a detersive amount of nonionic surfactant or a mixture of nonionic surfactants. In an aspect of the invention, the cleaning composition includes at least one nonionic surfactant, preferably a combination of nonionic surfactants. Nonionic surfactants are included in the cleaning compositions to enhance grease removal properties. Additional description of suitable nonionic surfactants is set forth in the treatise Nonionic Surfactants, edited by Schick, M. J., Vol. 1 of the Surfactant Science Series, Marcel Dekker, Inc., New York, 1983, which is incorporated herein by reference in its entirety.

The nonionic surfactants are used to provide the resulting use solution with a desired detersive property. Preferably the compositions includes at least one of the following surfactants: an alkyl polyglycoside and an alcohol ethoxylate surfactant. A more preferred embodiment of the invention includes compositions with a combination of an alkyl polyglycoside and an alcohol ethoxylate surfactant.

In a further aspect, the compositions are free of anionic, cationic and/or amphoteric surfactants. Preferably, the compositions are free of cationic surfactants.

Alkyl Polyglycoside Surfactants

Suitable nonionic surfactants are alkylpolysaccharides. The nonionic alkylpolysaccharide surfactants include a hydrophobic group containing from about 6 to about 30 carbon atoms and a polysaccharide, e.g., a polyglycoside, hydrophilic group containing from about 1 to about 10 saccharide units. The surfactant may be an alkylpoyglycoside or an alkyl polypentoside. Any reducing saccharide containing 5 or 6 carbon atoms can be used, e.g., glucose, galactose and galactosyl moieties can be substituted for the glucosyl moieties. The intersaccharide bonds can be, e.g., between the one position of the additional saccharide units and the 2-, 3-, 4-, and/or 6-positions on the preceding saccharide units. Further description of these nonionic surfactants is disclosed in U.S. Pat. No. 4,565,647, which is incorporated herein by reference in its entirety.

In certain embodiments, compositions according to the invention employ between about 0.1 wt-% to about 50 wt-% alkyl polyglycoside(s), preferably between about 1 wt-% to about 50 wt-% alkyl polyglycoside(s), and more preferably between about 5 wt-% to about 20 wt-% alkyl polyglycoside(s).

Alcohol Ethoxylate Surfactants

Suitable nonionic surfactants for use in the cleaning compositions of the invention include alcohol alkoxylates. An suitable alcohol alkoxylate include linear alcohol ethoxylates such as Tomadol™ 1-5 which is a surfactant containing an alkyl group having 11 carbon atoms and 5 moles of ethylene oxide. Additional alcohol alkoxylates include alkylphenol ethoxylates, branched alcohol ethoxylates, secondary alcohol ethoxylates (e.g., Tergitol 15-S-7 from Dow Chemical), castor oil ethoxylates, alkylamine ethoxylates, tallow amine ethoxylates, fatty acid ethoxylates, sorbital oleate ethoxylates, end-capped ethoxylates, or mixtures thereof. Additional nonionic surfactants include amides such as fatty alkanolamides, alkyldiethanolamides, coconut diethanolamide, lauric diethanolamide, polyethylene glycol cocoamide (e.g., PEG-6 cocoamide), oleic diethanolamide, or mixtures thereof. Additional suitable nonionic surfactants include polyalkoxylated aliphatic base, polyalkoxylated amide, glycol esters, glycerol esters, amine oxides, phosphate esters, alcohol phosphate, fatty triglycerides, fatty triglyceride esters, alkyl ether phosphate, alkyl esters, alkyl phenol ethoxylate phosphate esters, alkyl polysaccharides, block copolymers, alkyl polyglucosides, or mixtures thereof.

In certain embodiments, compositions according to the invention employ between about 0.1 wt-% to about 50 wt-% alcohol alkoxylate(s), preferably between about 1 wt-% to about 50 wt-% alcohol alkoxylate(s), and more preferably between about 5 wt-% to about 20 wt-% alcohol alkoxylate(s).

Additional Nonionic Surfactants

Additional nonionic surfactants that can be used in the composition include polyalkylene oxide surfactants (also known as polyoxyalkylene surfactants or polyalkylene glycol surfactants). Suitable polyalkylene oxide surfactants include polyoxypropylene surfactants and polyoxyethylene glycol surfactants. Suitable surfactants of this type are synthetic organic polyoxypropylene (PO)-polyoxyethylene (EO) block copolymers. These surfactants include a di-block polymer comprising an EO block and a PO block, a center block of polyoxypropylene units (PO), and having blocks of polyoxyethylene grafted onto the polyoxypropylene unit or a center block of EO with attached PO blocks. Further, this surfactant can have further blocks of either polyoxyethylene or polyoxypropylene in the molecules. A suitable average molecular weight range of useful surfactants can be about 1,000 to about 40,000 and the weight percent content of ethylene oxide can be about 10-80 wt. %.

In certain embodiments, compositions according to the invention employ between about 0.1 wt-% to about 50 wt-% nonionic surfactant(s), preferably between about 1 wt-% to about 50 wt-% nonionic surfactant(s), and more preferably between about 5 wt-% to about 20 wt-% nonionic surfactant(s).

Water

Preferably the cleaning compositions according to the invention are aqueous systems and therefore also include water. It should be appreciated that the water may be provided in a variety of forms, including for example, deionized water or softened water. Preferably, the water is relatively free of hardness. It is expected that the water can be deionized to remove a portion of the dissolved solids. That is, the composition can be formulated with water that includes dissolved solids, and can be formulated with water that can be characterized as hard water.

Additional Functional Ingredients

The cleaning compositions can include additional components or agents, such as additional functional ingredients. The functional materials provide desired properties and functionalities to the cleaning composition. For the purpose of this application, the term "functional ingredient" include a material that when dispersed or dissolved in a use and/or concentrate solution, such as an aqueous solution, provides a beneficial property in a particular use.

Suitable additional functional ingredients may include, for example, soil-digesting components, detergent fillers, surfactants, enzymes, antimicrobials, acidulants, complexing agents, corrosion inhibitors, foam inhibitors, dyes, thickening or rheology modifiers, polymers, antiredeposition agents, stabilizing agents, dispersion agents, chelating agents, bleaching agents, water conditioning agents, solidifying agents, and perfumes, some of which are described, for example, in U.S. Pat. No. 7,341,983, which is herein incorporated herein by reference in its entirety.

Particular examples of functional materials are discussed in more detail below, but it should be understood by those of skill in the art and others that the particular materials discussed are given by way of example only, and that a broad variety of other functional materials may be used. For example, many of the functional materials discussed below relate to materials used in cleaning applications, but it should be understood that other embodiments may include functional materials for use in other applications.

Acid or Alkalinity Sources

An acid or alkalinity source may be included in the cleaning compositions of the invention. An acid or alkalinity source may function to alter the pH of the composition and/or to neutralize other components in the composition, such as for example, the water conditioning agent. An example of a suitable acid source includes, but is not limited to, citric acid. An example of an alkalinity source is sodium carbonate. The acid or alkalinity source controls the pH of the resulting solution when water is added to the cleaning composition to form a use solution. The pH of the use solution must be maintained in the neutral to slightly alkaline range in order to provide sufficient detergency properties. This is possible because the soil removal properties of the cleaning composition are primarily due to the solvent and surfactants, rather than the alkalinity of the cleaning composition.

In one embodiment, sufficient acid or alkalinity source is added to establish a pH of the composition between about 4 and about 10. In particular, the pH of the of the cleaning composition is between about 5 and about 9, and more preferably between about 6 and about 8.

Water Conditioning and/or Chelating Agents

Water conditioning agents may be included in the cleaning compositions of the invention to aid in removing metal compounds and in reducing harmful effects of hardness components in water sources, such as service waters. Exemplary water conditioning agents include chelating agents, sequestering agents and inhibitors. Polyvalent metal cations or compounds such as a calcium, a magnesium, an iron, a manganese, a molybdenum, etc. cation or compound, or mixtures thereof, can be present in service water and in complex soils. Such compounds or cations can interfere with the effectiveness of a washing or rinsing compositions during a cleaning application. A water conditioning agent can effectively complex and remove such compounds or cations from soiled surfaces. Both organic and inorganic water conditioning agents are common and can be used. Inorganic water conditioning agents include such compounds as sodium tripolyphosphate and other higher linear and cyclic polyphosphates species. Organic water conditioning agents include both polymeric and small molecule water conditioning agents. Organic small molecule water conditioning agents are typically organocarboxylate compounds or organophosphate water conditioning agents. Polymeric inhibitors commonly comprise polyanionic compositions such as polyacrylic acid compounds. Small molecule organic water conditioning agents include, but are not limited to: sodium citrate, sodium gluconate, sodium glucoheptonate, N-hydroxyethylenediaminetriacetic acid (HEDTA), ethylenediaminetetraacetic acid (EDTA), nitrilotriacetic acid (NTA), diethylenetriaminepentaacetic acid (DTPA), ethylenediaminetetraproprionic acid, triethylenetetraaminehexaacetic acid (TTHA), and the respective alkali metal, ammonium and substituted ammonium salts thereof, ethylenediaminetetraacetic acid tetrasodium salt (EDTA), nitrilotriacetic acid trisodium salt (NTA), ethanoldiglycine disodium salt (EDG), diethanolglycine sodium-salt (DEG), and 1,3-propylenediaminetetraacetic acid (PDTA), dicarboxymethyl glutamic acid tetrasodium salt (GLDA), methylglycine-N—N-diacetic acid trisodium salt (MGDA), and iminodisuccinate sodium salt (IDS). All of these are known and commercially available.

In a further embodiment of the invention, a chelating agent is employed to provide additional soil removal efficacy. Exemplary chelating agents according to the invention include, for example, glutamic acid diacetic acid and sodium citrate.

Thickening Agents

The viscosity of the cleaning composition increases with the amount of thickening agent, and viscous compositions are useful for uses where the cleaning composition clings to the surface. Suitable thickeners can include those which do not leave contaminating residue on the surface to be treated. Generally, thickeners which may be used in the present invention include natural gums such as xanthan gum, guar gum, modified guar, or other gums from plant mucilage; polysaccharide based thickeners, such as alginates, starches, and cellulosic polymers (e.g., carboxymethyl cellulose, hydroxyethyl cellulose, and the like); polyacrylates thickeners; and hydrocolloid thickeners, such as pectin. Generally, the concentration of thickener employed in the present compositions or methods will be dictated by the desired viscosity within the final composition.

Bleaching Agents

The cleaning composition may also include bleaching agents for lightening or whitening a substrate. Examples of suitable bleaching agents include bleaching compounds capable of liberating an active halogen species, such as $Cl_2$, $Br_2$, —OCl— and/or —OBr—, under conditions typically encountered during the cleansing process. Suitable bleaching agents for use in the present cleaning compositions include, for example, chlorine-containing compounds such as a chlorine, a hypochlorite, and chloramine. Exemplary halogen-releasing compounds include the alkali metal dichloroisocyanurates, chlorinated trisodium phosphate, the alkali metal hypochlorites, monochloramine and dichloramine, and the like. Encapsulated chlorine sources may also be used to enhance the stability of the chlorine source in the composition (see, for example, U.S. Pat. Nos. 4,618,914 and 4,830,773, the disclosures of which are incorporated by reference herein for all purposes). A bleaching agent may also be a peroxygen or active oxygen source such as hydrogen peroxide, perborates, sodium carbonate peroxyhydrate, phosphate peroxyhydrates, potassium permonosulfate, and sodium perborate mono and tetrahydrate, with and without activators such as tetraacetylethylene diamine, and the like. The composition can include an effective amount of a bleaching agent.

Detergent Fillers

The cleaning composition can include an effective amount of detergent fillers, which does not perform as a cleaning agent per se, but cooperates with the cleaning agent to enhance the overall cleaning capacity of the composition. Examples of detergent fillers suitable for use in the present cleaning compositions include sodium sulfate, sodium chloride, starch, sugars, $C_{1-10}$, $C_{10}$ alkylene glycols such as propylene glycol, and the like.

Defoaming Agents

The cleaning composition can include a defoaming agent to reduce the stability of foam and reduce foaming. Examples of defoaming agents that can be used in the composition includes ethylene oxide/propylene oxide block copolymers such as those available under the name Pluronic N3, silicone compounds such as silica dispersed in polydimethylsiloxane, polydimethylsiloxane, and functionalized polydimethylsiloxane such as those available under the name Abil B9952, fatty amides, hydrocarbon waxes, fatty acids, fatty esters, fatty alcohols, fatty acid soaps, ethoxylates, mineral oils, polyethylene glycol esters, alkyl phosphate esters such as monostearyl phosphate, and the like. A discussion of defoaming agents may be found, for example, in U.S. Pat. Nos. 3,048,548, 3,334,147 and 3,442,242, the disclosures of which are incorporated herein by reference in their entirety.

Antiredeposition Agents

The cleaning composition can include an anti-redeposition agent for facilitating sustained suspension of soils in a cleaning solution and preventing the removed soils from being redeposited onto the substrate being cleaned. Examples of suitable anti-redeposition agents include fatty acid amides, fluorocarbon surfactants, complex phosphate esters, styrene maleic anhydride copolymers, and cellulosic derivatives such as hydroxyethyl cellulose, hydroxypropyl cellulose, methyl cellulose, and the like.

Stabilizing Agents

Stabilizing agents that can be used in the cleaning composition include, but are not limited to: primary aliphatic amines, sulfosuccinates, borate, calcium ions, sodium citrate, citric acid, sodium formate, glycerine, malonic acid, organic diacids, polyols, propylene glycol, and mixtures thereof. The concentrate need not include a stabilizing agent, but when the concentrate includes a stabilizing agent, it can be included in an amount that provides the desired level of stability of the concentrate.

Dispersants

Dispersants that can be used in the cleaning composition include maleic acid/olefin copolymers, polyacrylic acid, and its copolymers, and mixtures thereof. The concentrate need not include a dispersant, but when a dispersant is included it can be included in an amount that provides the desired dispersant properties.

Solidifying Agents

Solidifying agents that can be used in the cleaning compositions include a variety of hardening or solidifying agents, including for example, urea and/or polyethylene glycol. A solidifying agent can be a compound or system of compounds, organic or inorganic, which contribute to the uniform solidification of solid cleaning compositions according to the invention. Preferably, the solidifying agents are compatible with the cleaning agent and other active ingredients of the composition and are capable of providing an effective amount of hardness and/or aqueous solubility to the processed composition. The solidifying agents should also be capable of forming a homogeneous matrix with the cleaning agent and other ingredients when mixed and solidified to provide a uniform dissolution of the cleaning agent from the solid composition during use.

The amount of solidifying agent included in the solid composition will vary according to factors including, but not limited to: the type of solid composition being prepared, the ingredients of the solid composition, the intended use of the composition, the quantity of dispensing solution applied to the solid composition over time during use, the temperature of the dispensing solution, the hardness of the dispensing solution, the physical size of the solid detergent composition, the concentration of the other ingredients, and the concentration of the cleaning agent in the composition. It is preferred that the amount of the solidifying agent included in the solid composition is effective to combine with the cleaning agent and other ingredients of the composition to form a homogeneous mixture under continuous mixing conditions and a temperature at or below the melting temperature of the solidifying agent.

It is also preferred that the solidifying agent form a matrix with the cleaning agent and other ingredients which will harden to a solid form under ambient temperatures of approximately 30° C. to approximately 50° C., particularly approximately 35° C. to approximately 45° C., after mixing ceases and the mixture is dispensed from the mixing system, within approximately 1 minute to approximately 3 hours, particularly approximately 2 minutes to approximately 2 hours, and particularly approximately 5 minutes to approximately 1 hour. A minimal amount of heat from an external source may be applied to the mixture to facilitate processing of the mixture. It is preferred that the amount of the solidifying agent included in the solid detergent composition is effective to provide a desired hardness and desired rate of controlled solubility of the processed composition when placed in an aqueous medium to achieve a desired rate of dispensing the cleaning agent from the solidified composition during use.

The solidifying agent may be an organic or an inorganic hardening agent. A preferred organic hardening agent is a polyethylene glycol (PEG) compound. The solidification rate of solid compositions comprising a polyethylene glycol solidifying agent will vary, at least in part, according to the amount and the molecular weight of the polyethylene glycol added to the composition. Examples of suitable polyethylene glycols include, but are not limited to: solid polyethylene glycols of the general formula $H(OCH_2CH_2)_nOH$, where n is greater than 15, particularly approximately 30 to approximately 1700. Typically, the polyethylene glycol is a solid in the form of a free-flowing powder or flakes, having a molecular weight of approximately 1,000 to approximately 100,000, particularly having a molecular weight of at least approximately 1,450 to approximately 20,000, more particularly between approximately 1,450 to approximately 8,000. The polyethylene glycol is present at a concentration of from approximately 1% to 75% by weight and particularly approximately 3% to approximately 15% by weight. Suitable polyethylene glycol compounds include, but are not limited to: PEG 4000, PEG 1450, and PEG 8000 among others, with PEG 4000 and PEG 8000 being most preferred. An example of a commercially available solid polyethylene glycol includes, but is not limited to: CARBOWAX, available from Union Carbide Corporation, Houston, Tex.

Urea particles can also be employed as solidifying agents in the solid compositions. The solidification rate of the compositions will vary, at least in part, to factors including, but not limited to: the amount, the particle size, and the shape of the urea added to the composition. For example, a particulate form of urea can be combined with a cleaning agent and other ingredients, and preferably a minor but effective amount of water. The amount and particle size of the urea is effective to combine with the cleaning agent and other ingredients to form a homogeneous mixture without the application of heat from an external source to melt the urea and other ingredients to a molten stage. It is preferred that the amount of urea included in the solid composition is effective to provide a desired hardness and desired rate of solubility of the composition when placed in an aqueous medium to achieve a desired rate of dispensing the cleaning agent from the solidified composition during use. In some embodiments, the composition includes between approximately 5% to approximately 90% by weight urea, particularly between approximately 8% and approximately 40% by weight urea, and more particularly between approximately 10% and approximately 30% by weight urea.

The urea may be in the form of prilled beads or powder. Prilled urea is generally available from commercial sources as a mixture of particle sizes ranging from about 8-15 U.S. mesh, as for example, from Arcadian Sohio Company, Nitrogen Chemicals Division. A prilled form of urea is preferably milled to reduce the particle size to about 50 U.S. mesh to about 125 U.S. mesh, particularly about 75-100 U.S. mesh, preferably using a wet mill such as a single or twin-screw extruder, a Teledyne mixer, a Ross emulsifier, and the like.

Dyes and Fragrances

Various dyes, odorants including perfumes, and other aesthetic enhancing agents may also be included in the cleaning composition. Dyes may be included to alter the appearance of the composition, as for example, any of a variety of FD&C dyes, D&C dyes, and the like. Additional suitable dyes include Direct Blue 86 (Miles), Fastusol Blue (Mobay Chemical Corp.), Acid Orange 7 (American Cyanamid), Basic Violet 10 (Sandoz), Acid Yellow 23 (GAF), Acid Yellow 17 (Sigma Chemical), Sap Green (Keystone Aniline and Chemical), Metanil Yellow (Keystone Aniline and Chemical), Acid Blue 9 (Hilton Davis), Sandolan Blue/Acid Blue 182 (Sandoz), Hisol Fast Red (Capitol Color and Chemical), Fluorescein (Capitol Color and Chemical), Acid Green 25 (BASF), Pylakor Acid Bright Red (Pylam), and the like.

Fragrances or perfumes that may be included in the compositions include, for example, terpenoids such as citronellol, aldehydes such as amyl cinnamaldehyde, a jasmine such as C1S-jasmine or jasmal, vanillin, and the like.

Methods of Use

According to an embodiment of the invention methods of using the renewable cleaning compositions are provided. In an aspect of the invention, the methods for use provide safe, sustainable cleaning methods effective at removing soils, including without limitation soils containing proteins, lard and oils.

The concentrate compositions of the present invention are preferably provided as a solid, liquid, gel, or a combination thereof. In one embodiment, the cleaning compositions may be provided as a concentrate such that the cleaning composition is substantially free of any added water or the concentrate may contain a nominal amount of water. The concentrate can be formulated without any water or can be provided with a relatively small amount of water in order to reduce the expense of transporting the concentrate. For example, the composition concentrate can be provided as a capsule or pellet of compressed powder, a solid, or loose powder, either contained by a water soluble material or not. In the case of providing the capsule or pellet of the composition in a material, the capsule or pellet can be introduced into a volume of water, and if present the water soluble material can solubilize, degrade, or disperse to allow contact of the composition concentrate with the water. For the purposes of this disclosure, the terms "capsule" and "pellet" are used for exemplary purposes and are not intended to limit the delivery mode of the invention to a particular shape.

The composition may be provided for use in a liquid concentrate composition. The composition may be diluted at a weight ratio of cleaner to water of dilution of up to about 1:256. Preferably, the concentrate composition is diluted to a 0.5 oz./gallon to a 16 oz./gallon use solution. In some aspects, the concentrate composition is diluted to a 1 oz./gallon to a 12 oz./gallon use solution. In other aspects, the concentrate composition is diluted to a 4 oz./gallon to a 8 oz./gallon use solution. In still other aspects, the concentrate composition is diluted to a 6 oz./gallon use solution.

When provided as a liquid concentrate composition, the concentrate can be diluted through dispensing equipment using aspirators, peristaltic pumps, gear pumps, mass flow meters, and the like. This liquid concentrate embodiment can also be delivered in bottles, jars, dosing bottles, bottles with dosing caps, and the like. The liquid concentrate composition can be filled into a multi-chambered cartridge insert that is then placed in a spray bottle or other delivery device filled with a pre-measured amount of water.

In yet another embodiment, the concentrate composition can be provided in a solid form that resists crumbling or other degradation until placed into a container. Such container may either be filled with water before placing the composition concentrate into the container, or it may be filled with water after the composition concentrate is placed into the container. In either case, the solid concentrate composition dissolves, solubilizes, or otherwise disintegrates upon contact with water. In a particular embodiment, the solid concentrate composition dissolves rapidly thereby allowing the concentrate composition to become a use composition and further allowing the end user to apply the use composition to a surface in need of cleaning. When the cleaning composition is provided as a solid, the compositions provided herein may be altered in a manner to solidify the cleaning composition by any means known in the art. For example, the amount of water may be reduced or additional ingredients may be added to the cleaning composition, such as a solidification agent.

In another embodiment, the solid concentrate composition can be diluted through dispensing equipment whereby water is sprayed at the solid block forming the use solution. The water flow is delivered at a relatively constant rate using mechanical, electrical, or hydraulic controls and the like. The solid concentrate composition can also be diluted through dispensing equipment whereby water flows around the solid block, creating a use solution as the solid concentrate dissolves. The solid concentrate composition can also be diluted through pellet, tablet, powder and paste dispensers, and the like.

The water used to dilute the concentrate (water of dilution) can be available at the locale or site of dilution. The water of dilution may contain varying levels of hardness depending upon the locale. Service water available from various municipalities have varying levels of hardness. It is desirable to provide a concentrate that can handle the hardness levels found in the service water of various municipalities. The water of dilution that is used to dilute the concentrate can be characterized as hard water when it includes at least 1 grain hardness. It is expected that the water of dilution can include at least 5 grains hardness, at least 10 grains hardness, or at least 20 grains hardness.

In an alternate embodiment, the cleaning compositions may be provided as a ready-to-use (RTU) composition. If the cleaning composition is provided as a RTU composition, a more significant amount of water is added to the cleaning composition as a diluent. When the concentrate is provided as a liquid, it may be desirable to provide it in a flowable form so that it can be pumped or aspirated. It has been found that it is generally difficult to accurately pump a small amount of a liquid. It is generally more effective to pump a larger amount of a liquid. Accordingly, although it is desirable to provide the concentrate with as little water as possible in order to reduce transportation costs, it is also desirable to provide a concentrate that can be dispensed accurately. In the case of a liquid concentrate, it is expected that water will be present in an amount of up to about 90 wt-%, particularly between about 20 wt-% and about 85 wt-%, more particularly between about 30 wt-% and about 80 wt-% and most particularly between about 50 wt-% and about 80 wt-%.

The cleaning compositions of the invention may be useful to clean a variety of surfaces. In an aspect of the invention, the cleaning composition contacts an article in need of cleaning, namely hard surfaces including but not limited to ceramics, ceramic tile, grout, granite, concrete, mirrors, enameled surfaces, metals including aluminum, brass, stainless steel and the like.

In one embodiment, the cleaning composition may be provided as a ready-to-use composition on a disposable wipe substrate. In certain embodiments, a disposable wipe substrate may be pre-saturated with the cleaning composition according to the invention.

In some embodiments, the cleaning compositions of the invention are used to clean grease, oil, adhesive, asphalt, labels and/or other stained from hard surfaces. In some embodiments, the cleaning compositions of the invention may also be used for cleaning textiles, including for example as pre-spotters for cleaning soiled linens such as towels, sheets, and nonwoven webs. As such, compositions of the invention are useful to formulate hard surface cleaners, laundry detergents, oven cleaners, hand soaps, automotive detergents, and warewashing detergents whether automatic or manual.

In the event the cleaning compositions are used for floor cleaners or cleaning other large surface areas, they can be applied using a variety of methods and tools, including automatic scrubber, spraying, brushing, flat or string mopping, roll coating, applying with a paint roller, applying with a T-bar applicator, and flood coating. Mop application, especially flat mopping, is preferred for cleaning most floors. Suitable mops include those described in U.S. Pat. Nos. 5,315,734, 5,390,390, 5,680,667 and 5,887,311, the complete disclosures of which are hereby incorporated by reference in their entirety.

All publications and patent applications in this specification are indicative of the level of ordinary skill in the art to which this invention pertains. All publications and patent applications are herein incorporated by reference to the same extent as if each individual publication or patent application was specifically and individually indicated as incorporated by reference.

EXAMPLES

Embodiments of the present invention are further defined in the following non-limiting Examples. It should be understood that these Examples, while indicating certain embodiments of the invention, are given by way of illustration only. From the above discussion and these Examples, one skilled in the art can ascertain the essential characteristics of this invention, and without departing from the spirit and scope thereof, can make various changes and modifications of the embodiments of the invention to adapt it to various usages and conditions. Thus, various modifications of the embodiments of the invention, in addition to those shown and described herein, will be apparent to those skilled in the art from the foregoing description. Such modifications are also intended to fall within the scope of the appended claims.

Example 1

Methods for evaluating the performance of all-purpose cleaners and floor cleaners were performed using the following materials:

Control: Oasis Pro® 16 all-purpose cleaner available from Ecolab Inc., Saint Paul, Minn. The control is not considered a "green" alternative.

Compositions A and B: ethyl laurate non-volatile solvent all-purpose cleaners (27% actives) according to embodiments the invention. Two ethyl laurate solvent systems according to embodiments of the invention were formulated according to Table 2.

TABLE 2

| Ingredient | Composition A | Composition B |
|---|---|---|
| Water | 14.99 | 51.4 |
| Glutamic acid diacetic acid | 0 | 10 |
| $MgCl_2$ (30%) | 4.33 | 0 |
| Sodium lauryl sulfate (30%) | 57.78 | 0 |
| Alkyl polyglycosides | 12.9 | 17.5 |
| Undeceth-5 | 0 | 11.1 |
| Citric Acid (50%) | 2 | 2 |
| d-Limonene | 1.6 | 1.6 |
| Ethyl laurate (ethyl dodecanoate) | 6.4 | 6.4 |
| Total | 100 | 100 |

Black Soil Removal Test. A black soil including about 50 grams mineral spirits, about 5 grams mineral oil, about 5 grams motor oil, about 2.5 grams black pigment dispersion and about 37.5 grams bandy black clay was prepared.

A plurality of 3×3' white vinyl tiles were soiled on the back, grooved side with approximately 0.75 grams of the black test soil using a 3" foam brush. The tiles were allowed to dry at room temperature overnight. The next day, the tiles were placed into a soaking tray containing about 200 grams of the cleaning composition for about 2 minutes. The soil removal test was conducted using a Precision Force Applicator (PFA), available from Precision Analytical Instruments, Inc., using a synthetic sponge. The sponge was pre-dampened with water with the excess water squeezed out and then saturated with about 50 grams of the test compositions.

The tiles were then placed into the PFA with the grain of the tiles parallel to the direction of sponge travel. The tiles were then scrubbed with about 2 pounds of pressure with the moistened synthetic sponge for 40 cycles, rotating the tiles 90 degrees every 10 cycles for a complete 360 degree rotation of the tiles. The tiles were then rinsed with city water and dried overnight at room temperature. The average percentage reflectance change of the black soil removal was calculated by the following equation:

$$\%\ \text{Clean} = \frac{((\text{Reflectance of Cleaned tile}) - (\text{Reflectance of Soiled tile}))}{((\text{Reflectance of New tile}) - (\text{Reflectance of Soiled tile}))}$$

The formulations were evaluated at low and intermediate concentrations (i.e., 4 oz./gallon, 6 oz./gallon and 8 oz./gallon, respectively). The efficacy of the evaluated control and test Compositions A and B formulations against the black soil are shown graphically in FIG. 1. As shown the test Compositions A and B providing a non-volatile, clean solvent composition provided substantially similar cleaning efficacy against black soils as the control (which is not a "green" alternative). It is surprising that the replacement of conventional, volatile solvents with the non-volatile ethyl laurate (ethyl dodecanoate) provides substantially-similar cleaning efficacy according to the invention.

Example 2

Additional testing of the performance of all-purpose cleaners and floor cleaners was performed using an alternative Control than the control employed in Example 1. An additional formulation of the ethyl laurate non-volatile all-purpose cleaner of the invention was evaluated using the black soil removal methods described in Example 1. The methods for evaluating the performance of various dilutions and concentrations of the all-purpose cleaners and floor cleaners according to the invention were performed using the following materials:

Control: QC® 51 all-purpose cleaner available from Ecolab Inc., Saint Paul, Minn. The control is a conventional cleaning product.

Composition C: ethyl laurate non-volatile solvent all-purpose cleaners (22.6% actives) according to embodiments the invention as shown in Table 3.

TABLE 3

| Ingredient | Composition C |
|---|---|
| Water | 69.4 |
| Glutamic acid diacetic acid | 0 |
| Sodium citrate | 4 |
| Sodium lauryl sulfate (30%) | 0 |
| Alkyl polyglycoside | 14 |
| Undeceth-5 (Tomadol 1-5) | 6.5 |

TABLE 3-continued

| Ingredient | Composition C |
|---|---|
| Citric Acid (50%) | 0.1 |
| Ethyl laurate (ethyl dodecanoate) | 6 |
| Total | 100 |

Figure 2:
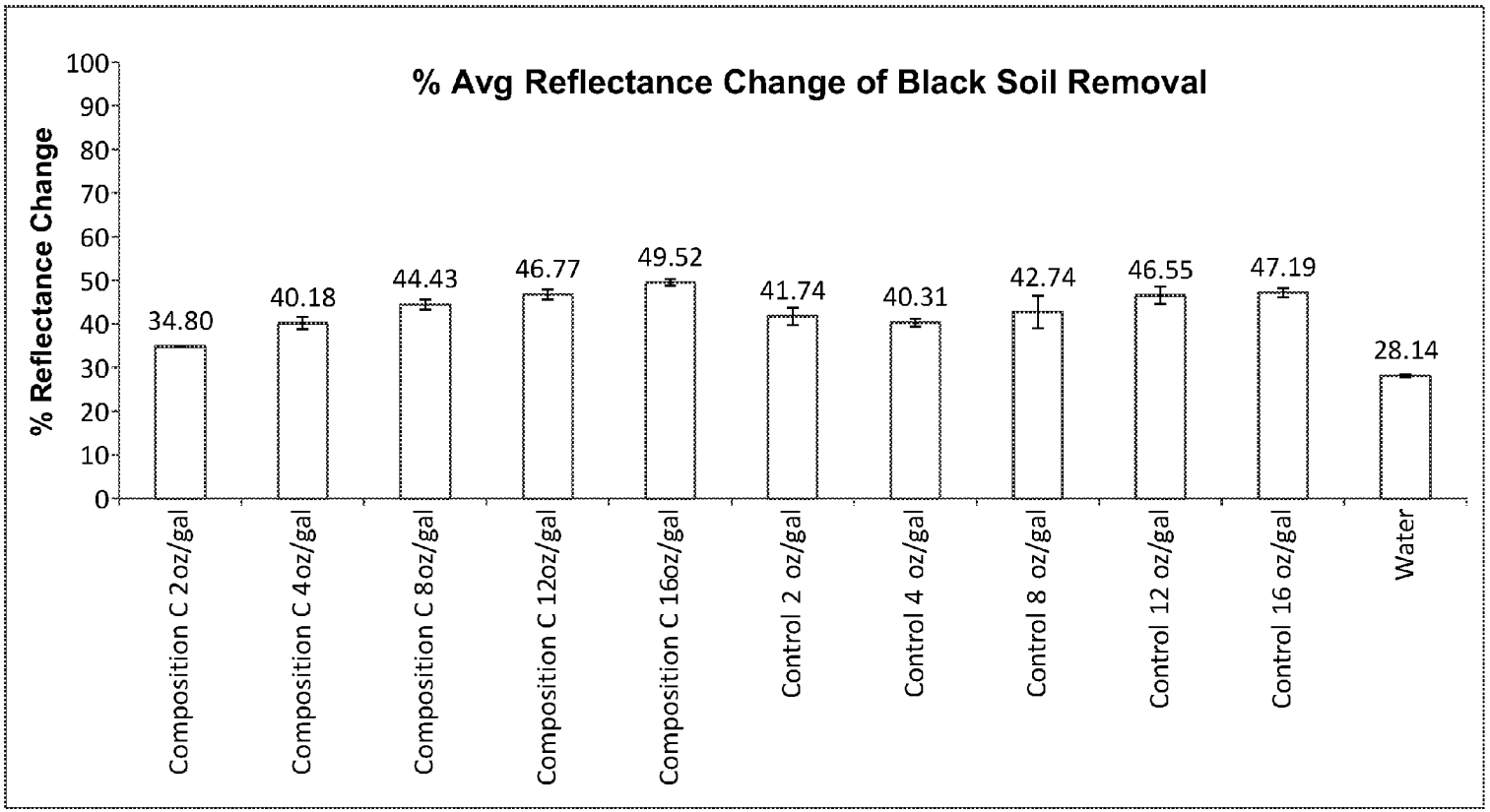
FIG. 2 shows efficacy of soil removal of a non-volatile all-purpose cleaning according to the invention and described in Example 2 at low and high concentrations in comparison to control cleaning compositions.

Various dilutions of the test Composition C and the Control were evaluated. Low, intermediate and high concentrations were tested (i.e., 2 oz./gallon, 4 oz./gallon, 8 oz./gallon, and 12 oz./gallon and 16 oz./gallon). The efficacy of the evaluated control and test Composition C against the black soil are shown graphically in FIG. 2.

As shown, test Composition C provides a non-volatile, clean solvent composition that outperforms the Control formulation against black soils at high concentrations, namely at and above 8 oz./gallon formulations. At lower concentrations of 2 oz./gallon and 4 oz./gallon the test Composition C provides substantially similar cleaning efficacy against black soils. This comparable cleaning efficacy is accompanied by additional benefits of the non-volatile solvent cleaning compositions of the invention in comparison to the Control, including for example low to no-VOC and replacement of at least portions of conventional chemistry/solvents. Under certain conditions the Composition provides improved (i.e. lower or no-VOC) in comparison to the Control, including additional compliance with sustainable certification programs such as potentially Green Seal GS-37, EPA DfE, USDA Bio-Preferred, etc.

According to the invention, it is surprising that the replacement of conventional, volatile solvents with the non-volatile ethyl laurate (ethyl dodecanoate) provides substantially-similar cleaning efficacy at low concentrations, and improved cleaning efficacy at higher concentrations (at or above 8 oz./gallon) according to the invention.

Example 3

Additional testing of the performance of all-purpose cleaners and floor cleaners were performed using a "green" control and addition formulations of the ethyl laurate all-purpose cleaners of the invention. The methods described in Example 1 were again utilized for evaluating the performance of all-purpose cleaners and floor cleaners using the following materials:

Control: Oasis Pro® 16 all-purpose cleaner available from Ecolab Inc., Saint Paul, Minn. The control is not considered a "green" alternative.

Control ("Green"): Bio-based B.2 and B.3 experimental formulations with greater than 55 wt-% bio-based carbon.

Composition D: ethyl laurate non-volatile solvent all-purpose cleaners according to embodiments the invention as shown in Table 4 (26% actives).

TABLE 4

| Ingredient | Composition D |
|---|---|
| Water | 66.75 |
| Sodium citrate | 4.0 |
| Alkyl polyglycoside | 9.5 |
| C12-15 pareth 7 (Tomadol 25-7) | 4.0 |
| Undeceth-5 (Tomadol 1-5) | 4.5 |
| Citric Acid (50%) | 0.25 |

TABLE 4-continued

| Ingredient | Composition D |
|---|---|
| Ethyl laurate (ethyl dodecanoate) | 8 |
| Tripropylene glycol n-butyl ether | 3 |
| Total | 100 |

To confirm the superiority or at least substantially similar cleaning efficacy of the ethyl laurate all-purpose cleaning compositions of the invention, the Composition D formulation was compared to a bio-based (or "green") alternative cleaner, in addition to a non-green control cleaning composition. Lower concentrations were employed (2 oz./gallon, 4 oz./gallon and 8 oz./gallon) in comparison to Example 2.

Figure 3:
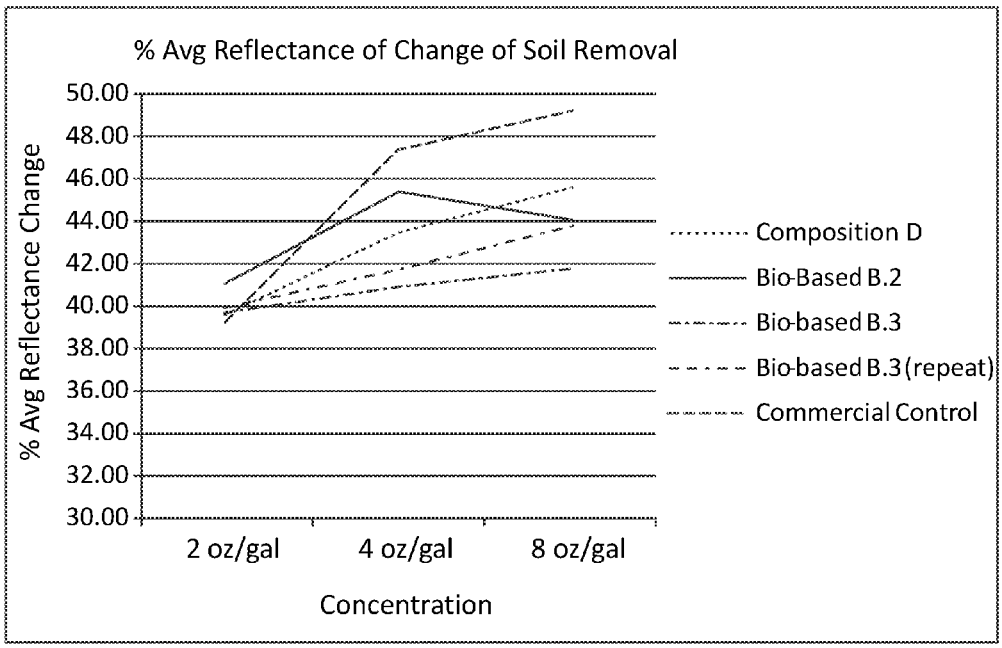
FIG. 3 shows efficacy of soil removal of a non-volatile all-purpose cleaning according to the invention and described in Example 3 in comparison to additional bio-based cleaning compositions.

As shown in FIG. 3, at lower concentrations (at or below 8 oz./gallon) the Composition D provided either superior or substantially similar cleaning efficacy against black soils.

Example 4

Microemulsion stability testing was also conducted to determine the temperature ranges suitable for maintaining a stable emulsion according to the invention. Formulations with the ranges found in Table 5 were evaluated at temperatures ranging from 4° C. to 50° C.

TABLE 5

| Compositions | 2.1, 2.2 | 2.5, | 2.8 | 2.9 | 2.10 | 2.11 | 2.12 |
|---|---|---|---|---|---|---|---|
| Water | 50-80 | 70-80 | 70-80 | 70-80 | 70-80 | 70-80 | 60-70 |
| Glutamic acid diacetic acid | 2-5 | 0 | 0 | 0 | 0 | 0 | 0 |
| Sodium citrate | 0 | 1-5 | 1-5 | 1-5 | 1-5 | 1-5 | 1-5 |
| Alkyl polyglycoside | 5-11 | 4-6 | 5-15 | 5-15 | 1-10 | 5-15 | 5-15 |
| Alcohol ethoxylate | 5-15 | 5-10 | 5-10 | 5-10 | 1-10 | 5-15 | 5-15 |
| Citric Acid (50%) | 5-1 | 0.01-1 | 1-4 | 0.01-1 | 0.01-1 | 0.01-1 | 0.01-1 |
| d-Limonene | 0 | 0 | 0 | 0 | 0 | 0 | 0 |
| Ethyl laurate non-volatile solvent | 4-8 | 1-5 | 5-10 | 1-5 | 5-10 | 1-5 | 5-10 |
| TPnB (tripropylene glycol butyl ether) | 0 | 0 | 0 | 1-5 | 0 | 1-5 | 0 |
| Total | 100 | 100 | 100 | 100 | 100 | 100 | 100 |
| Clarity at 70° F. (21° C.) | clear | clear | clear | clear | clear | clear | clear |
| Clarity at 4° C. | | clear | opaque | clear | clear | clear | |
| Clarity at 40° C. | | opaque | clear | clear | hazy | opaque | |
| Clarity at 50° C. | | opaque | clear | opaque | opaque | opaque | |

As shown in Table 5, the formulations of ethyl ester solvent systems according to the invention provide clear, stable compositions at room temperature.

The inventions being thus described, it will be obvious that the same may be varied in many ways. Such variations are not to be regarded as a departure from the spirit and scope of the inventions and all such modifications are intended to be included within the scope of the following claims.

What is claimed is:

1. An all-purpose cleaning composition comprising:

from about 0.1-50 wt-% of a non-volatile C8-16 ethyl ester solvent replacing at least about 40% of conventional solvents, wherein said solvent is ethyl laurate;

from about 0.1-50 wt-% of an alkyl polyglycoside surfactant;

from about 0.1-50 wt-% of undeceth-5;

water;

a chelating agent that is either sodium citrate or glutamic acid diacetic acid; and at least one additional functional ingredient, wherein the composition is free of anionic, cationic and amphoteric surfactants.

2. The composition of claim 1, wherein the additional functional ingredient is a water conditioning agent, a solidifying agent, a thickening agent, a bleaching agent, a defoaming agent, an antiredeposition agent, a dispersion agent, and/or a stabilizing agent.

3. The composition of claim 2, wherein the C8-16 ethyl ester replaces at least about 70% of conventional solvents.

4. The composition of claim 1, wherein the C8-16 ethyl ester replaces about 100% of conventional solvents.

5. The composition of claim 1, wherein the alkyl polyglycoside surfactant is between about 5 wt-% and about 20 wt-% of the cleaning composition, wherein the undeceth-5 is between about 5 wt-% and about 20 wt-% of the cleaning composition, wherein the non-volatile solvent is between about 0.1 wt-% and about 25 wt-% of the cleaning composition, and wherein the additional functional ingredient is between about 1 wt-% and about 25 wt-% of the cleaning composition.

6. The composition of claim 1, wherein the cleaning composition has a pH between about 4 and about 10.

7. The composition of claim 1, wherein the chelating agent is sodium citrate.

8. The composition of claim 1, wherein the composition is free of chlorinated solvents, methyl esters, and aromatic hydrocarbons, and wherein the composition is alkyl phenol ethoxylate-free.

9. The composition of claim 1, wherein the chelating agent is glutamic acid diacetic acid.

10. An all-purpose cleaning composition comprising:

from about 0.1-25 wt-% of a C10-14 ethyl ester non-volatile solvent replacing at least about 50% of conventional solvents, wherein said solvent is ethyl laurate;

from about 1-20 wt-% of an alkyl polyglycoside surfactant and from about 1-20 wt-% of undeceth-5;

from about 0.1-25 wt-% of a sodium citrate or glutamic acid diacetic acid chelating agent; and water, wherein the composition is free of anionic, cationic and amphoteric surfactants, and wherein the composition is free of chlorinated solvents, methyl esters, and aromatic hydrocarbons, and wherein the composition has a pH between about 4 and about 10.

11. The composition of claim 10, further comprising an additional functional ingredient.

12. The composition of claim 10, wherein the C10-14 ethyl ester replaces about 80% of conventional solvents.

13. The composition of claim 11, wherein the additional functional ingredient is a water conditioning agent, a solidifying agent, a thickening agent, a bleaching agent, a defoaming agent, an antiredeposition agent, a dispersion agent, and/or a stabilizing agent.

14. The composition of claim 10, wherein the chelating agent is sodium citrate.

15. The composition of claim 10, wherein the pH is between about 5 and about 9.

16. A method of removing soils from a surface using a natural, non-volatile all purpose cleaning composition, comprising:

(a) diluting a cleaner with water of dilution to form a use solution, wherein the cleaner comprises the composition of claim 1; and (b) contacting the surface with the use solution.

17. The method of claim 16, wherein the soil includes up to about 20% protein and the functional ingredient is an organic hardening agent.

18. The method of claim 16, wherein diluting the cleaner with water of dilution comprises diluting at weight ratio of cleaner to water of dilution of up to about 1:256 and the functional ingredient is a chelating agent.

* * * * *